US007760146B2

(12) United States Patent
Ollikainen

(10) Patent No.: US 7,760,146 B2
(45) Date of Patent: Jul. 20, 2010

(54) INTERNAL DIGITAL TV ANTENNAS FOR HAND-HELD TELECOMMUNICATIONS DEVICE

(75) Inventor: Jani Ollikainen, Helsinki (FI)

(73) Assignee: Nokia Corporation, Espoo (FI)

( * ) Notice: Subject to any disclaimer, the term of this patent is extended or adjusted under 35 U.S.C. 154(b) by 650 days.

(21) Appl. No.: 11/388,802

(22) Filed: Mar. 24, 2006

(65) Prior Publication Data

US 2006/0214857 A1 Sep. 28, 2006

Related U.S. Application Data

(60) Provisional application No. 60/665,902, filed on Mar. 24, 2005.

(51) Int. Cl.
*H01Q 1/24* (2006.01)
*H01Q 1/50* (2006.01)
*H01Q 3/24* (2006.01)

(52) U.S. Cl. ..... 343/702; 343/860; 343/876

(58) Field of Classification Search ..... 343/702, 343/700 MS, 876, 850, 860, 895
See application file for complete search history.

(56) References Cited

U.S. PATENT DOCUMENTS 5,734,355 A * 3/1998 Watanabe ..... 343/859
2005/0186931 A1* 8/2005 Laiho et al. ..... 455/280
2006/0099993 A1* 5/2006 Leinonen et al. ..... 455/562.1
2006/0135061 A1* 6/2006 Ying ..... 455/19
2006/0197538 A1* 9/2006 Leinonen et al. ..... 324/533

OTHER PUBLICATIONS

IEEE 0-7803-7954-3/03; J. Villanen et al.; "Compact Antenna Structures for Mobile Handsets"; pp. 40-44; 2003.

* cited by examiner

*Primary Examiner*—Shih-Chao Chen
(74) *Attorney, Agent, or Firm*—Ware, Fressola, Van Der Sluys & Adolphson LLP

(57) ABSTRACT

An antenna structure comprises an unbalanced antenna for receiving digital video broadcasting signals. The antenna is dimensioned to fit within an electronic device, such as a mobile phone. The unbalanced antenna has a radiative element and a feed line connected to a matching circuit so as to achieve two or more resonances within a DVB-H frequency range, such as 470 to 702 MHz. The physical length of the radiative element is always smaller than $\lambda/4$ at the frequencies of interest (470-702 MHz), but the electrical length can be smaller or substantially equal to $\lambda/4$. The matching circuit can comprise one or more LC resonators depending on the number of resonances. The resonators can be series or parallel connected between the feed line and RF circuitry for processing the broadcasting signals. The antenna can be tuned to other bands above the DVB-H frequencies for use as a diversity or MIMO antenna.

21 Claims, 11 Drawing Sheets

INTERNAL DIGITAL TV ANTENNAS FOR HAND-HELD TELECOMMUNICATIONS DEVICE

This application is based on and claims priority to U.S. provisional patent application Ser. No. 60/665,902, filed Mar. 24, 2005.

FIELD OF THE INVENTION

The present invention generally relates to a radio-frequency antenna and, more specifically, to an internal digital television antenna for use in a hand-held or portable telecommunications device, such as a mobile phone.

BACKGROUND OF THE INVENTION

Digital television is coming to hand-held mobile terminals, such as mobile phones. Currently an antenna designed to receive digital video broadcasting is conforming to DVB-H specification, which was developed in 2004 for accessing DVB services on hand-held devices. According to the DVB-H specification, data transmission is carried out in a time-slicing manner such that bursts of data are received at a time. As such, the receiver is allowed to be inactive for much of the time in order to save power. There are two frequency bands designated for DVB services: VHF band of 174-230 MHz and UHF band of 470-838 MHz. While it is desirable and advantageous to have an internal compact and unobtrusive DVB-H antenna for mobile terminals, it would be very difficult, if not impossible, to use a simple antenna that is small enough to fit inside current mobile phones even in the frequency range of 470-838 MHz.

One solution is to use a frequency-tunable narrow-band antenna. However, such an antenna is complicated to design and manufacture. Furthermore, non-linear switching and tuning components associated with the antenna are potential sources of interference problems in the mobile terminal because they are placed near the sources of high power cellular transmit antennas.

Owing to its relatively low operation frequency band, a digital television antenna has to be relatively large to function properly. An internal DVB-H antenna can increase the total volume occupied by all antennas inside a mobile terminal significantly. It is desirable and advantageous to develop new solutions to keep the total antenna volume small enough to permit terminal sizes that are still appealing to consumers.

SUMMARY OF THE INVENTION

The first aspect of the present invention provides a method to achieve at least two resonances in an internal antenna structure for receiving digital-video broadcasting signals in a frequency range. The frequency range can be between 470 MHz and 702 MHz, for example. The second aspect of the present invention provides an antenna structure for receiving digital-video broadcasting signals in a frequency range. The antenna structure can be implemented inside a hand-held electronic device and the frequency range can be between 470 MHz and 702 MHz. The hand-held electronic device can be a mobile television set, a gaming device, a mobile phone, a personal digital assistant (PDA) or the like. The present invention uses an unbalanced monopole-like resonant or non-resonant antenna structure that has a radiative element and a feed line, and a matching circuit having at least one resonance stage to achieve said at least two resonances, wherein the matching circuit comprises at least one resonator connected to the feed line.

According to the one embodiment of the present invention, the radiative element comprises a metal plate folded to have a better fit to the geometry of a mobile phone. The physical and electrical length of the radiative element is smaller than $\lambda/4$ at the frequency range between 470 MHz and 702 MHz. The antenna is resonated with an external matching circuit that makes the antenna dual-resonant or multi-resonant.

According to another embodiment of the present invention, the radiative element is an elongated strip of electrically conductive material folded at two sides such that while the physical length of the radiative element is smaller than $\lambda/4$ at the frequency range between 470 MHz and 702 MHz, the electrical length about $\lambda/4$. The antenna is made dual-resonant or multi-resonant by an external matching circuit.

The third aspect of the present invention provides an antenna structure for use in a hand-held telecommunications device for receiving digital-video broadcasting (DVB-H) signals and receiving (RX) and/or transmitting (TX) signals for any other radio system simultaneously or by taking turns. The antenna structure comprises an unbalanced antenna with an external matching circuit for receiving digital-video broadcasting signals in a frequency range between 470 MHz and 702 MHz, and one or more antennas for the cellular system or for other radio systems. The DVB-H antenna can be tuned to other bands above the DVB-H frequencies and used as a diversity of MIMO antenna.

The fourth aspect of the present invention provides an electronic device having an internal antenna structure for receiving digital-video broadcasting signals in a frequency range.

The present invention will become apparent upon reading the description taken in conjunction with FIGS. 1 to 11.

DETAILED DESCRIPTION OF THE INVENTION

The present invention provides an unbalanced antenna system for use in a portable device for receiving the DVB-H signals. Unlike a dipole antenna which is a balanced antenna, an inverted-L antenna, inverted-F antenna and other monopole antenna are unbalanced. In general, a balanced feed is defined as when a transmission line, comprising two conductors in the presence of ground, is capable of being operated in such a way that when voltages of the two conductors at all transverse planes are equal in magnitude and opposite in polarity with respect to ground, currents in the two conductors are essentially equal in magnitude and opposite in direction. An unbalanced feed does not fulfill the above criteria.

Based on the specification for typical performance of a DVB-H handset antenna in the 470-702 MHz range, the realized gain $G_{real}$ should be in the range of −10 dBi to −7 dBi. When designing a multiradio antenna system with an unbalanced multiresonant DVB-H antenna, design considerations include:

- Assumed antenna directivity
- Radiation efficiency with metal parts (reflection loss not included)
- Margin for implementation loss (plastic, phone mechanics)
- Reflection loss between −10 dBi (at 470 MHz) and −7 dBi (at 702 MHz) corresponding to a reflection coefficient $S_{11}$ of −0.5 dB to −1 dB using ideal components; better match is needed to compensate for power loss in matching components
- Ideal return loss at least about 0.5 dB to 1 dB; in practice at least 1 to 3 dB.
- The size (mainly the largest dimension) of the printed-wire board (PWB).
- The location of the antenna on the PWB A typical realized gain requirement for the DVB-H antenna over the whole frequency range of 470-702 MHz can be met by using, for example, an unbalanced monopole-like resonant or non-resonant antenna structure and a one to three resonator stage matching circuit to achieve a total number of 2 to 4 resonances. The number of needed resonators depends on the size (mainly largest dimension) of the PWB, and the location of the antenna on the PWB.

To achieve the required operation bandwidth, the consecutive resonators of the system of coupled resonators formed by an antenna and a matching network must have a strong enough coupling to each other (correct relative impedance levels). A correct coupling has been achieved when the impedance locus of the antenna on the Smith Chart contains one or more very large loops that enclose the center of the Smith Chart and only barely fit inside a constant reflection coefficient circle that represents a 1 dB return loss.

The method to achieve DVB-H antenna performance by combining an unbalanced antenna and one or more matching circuits has been carried out using two different embodiments as described below:

First Embodiment

Figure 1:
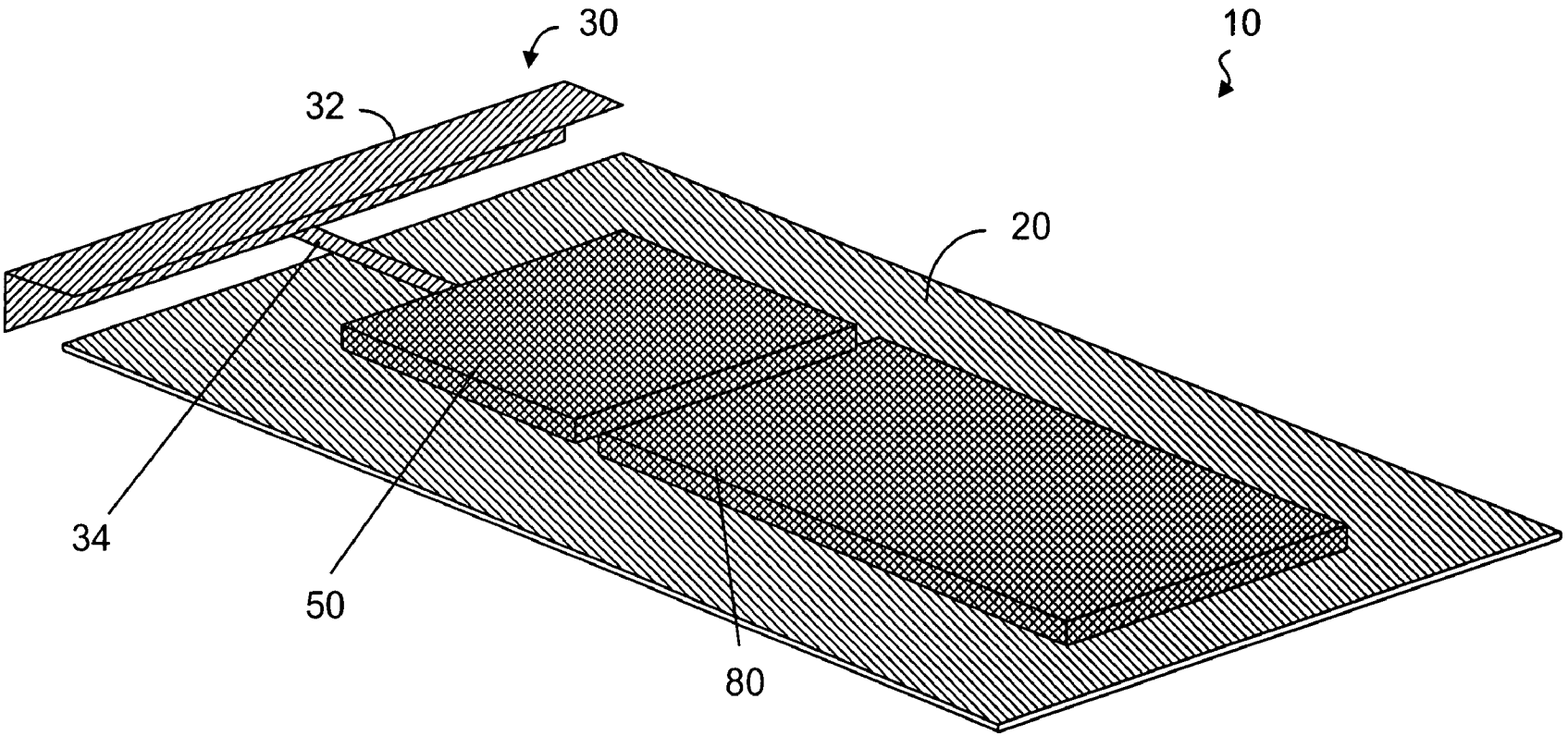
FIG. 1 shows an unbalanced non-resonant antenna according to the present invention.
Figure 2:
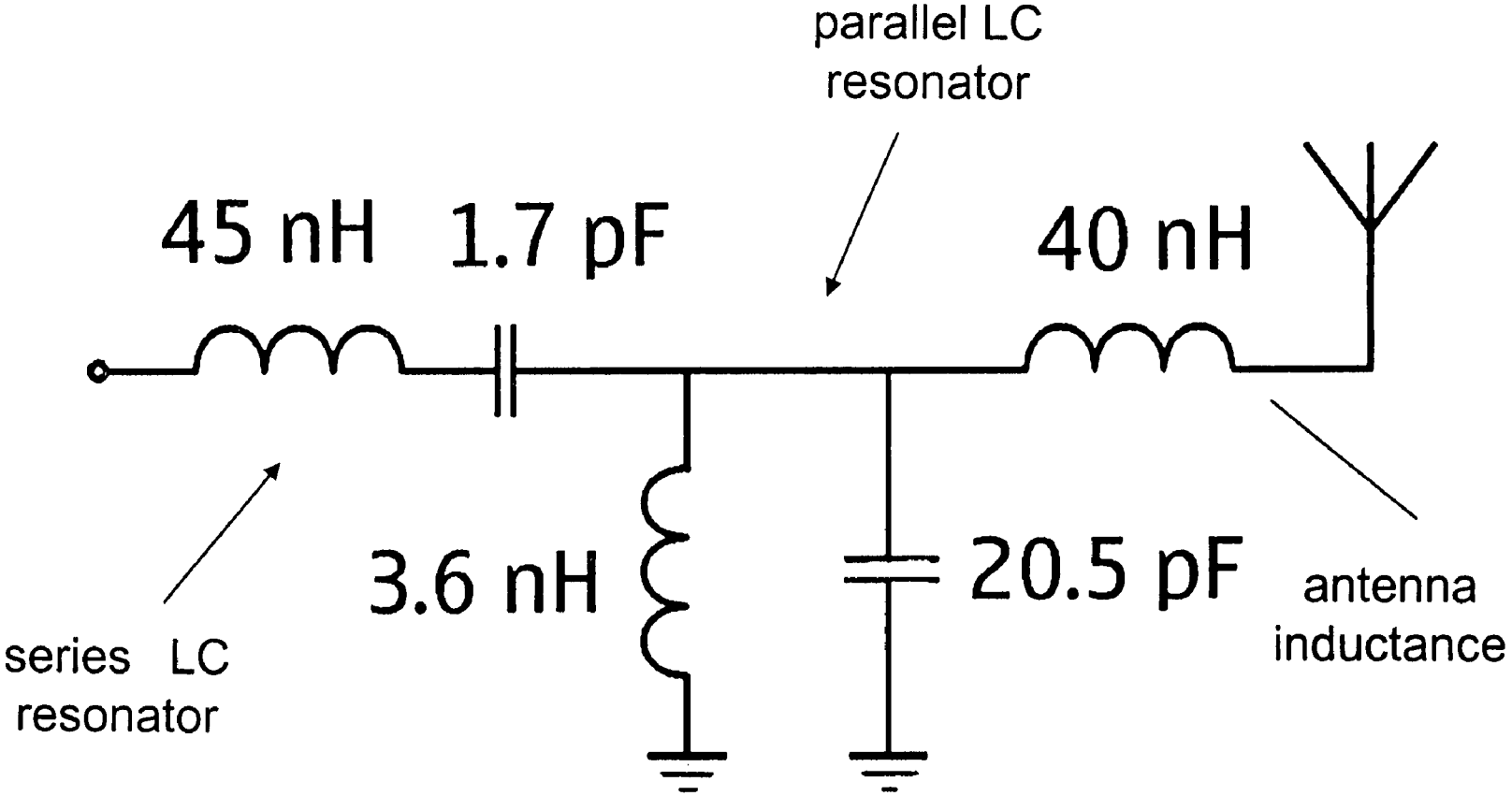
FIG. 2 shows an exemplary two-stage resonant matching circuit for use with the unbalanced antenna.

The first embodiment of the present invention is based on a non-resonant antenna structure. The radiative element of the antenna can be a metal plate folded to have a better fit to the geometry of a mobile terminal, as shown in FIG. 1. FIG. 1 illustrates a circuit board 10 having a printed wire board (PWB) 20 with a ground plane for implementing an unbalanced antenna 30 with a folded radiative element 32 and an antenna feed 34 connected between the radiative element 32 and the PWB 20. The physical and electrical lengths of the radiative element 32 are smaller than λ/4 at the frequencies of interest (470-702 MHz). The antenna feed 34 is a narrow strip of electrically conductive material connected to a section of the radiative element 32. The antenna is resonated with an external matching circuit, which makes the antenna dual-resonant or multi-resonant and which can be integrated to the antenna module if necessary. As shown in FIG. 1, a matching circuit 50 is connected in series between the antenna 30 and other RF circuitry 80 in an RF front-end. An exemplary matching circuit is shown in FIG. 2. The matching circuit is a two-stage resonant circuit having one parallel LC resonator and one series LC resonator.

Figure 3:
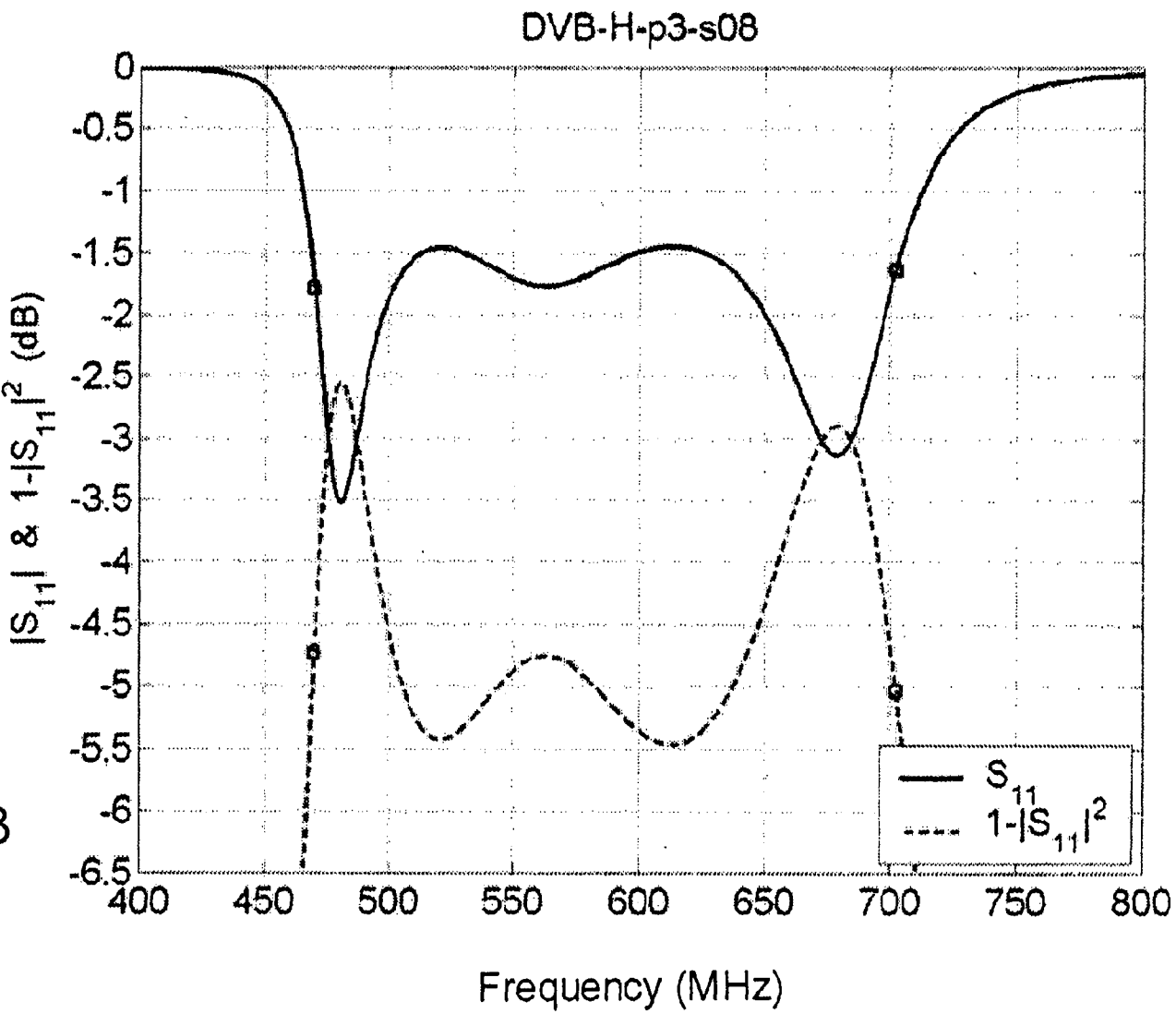
FIG. 3 shows a reflection coefficient S11 with two resonances in the frequency range between 470 MHz and 702 MHz.
Figure 4:
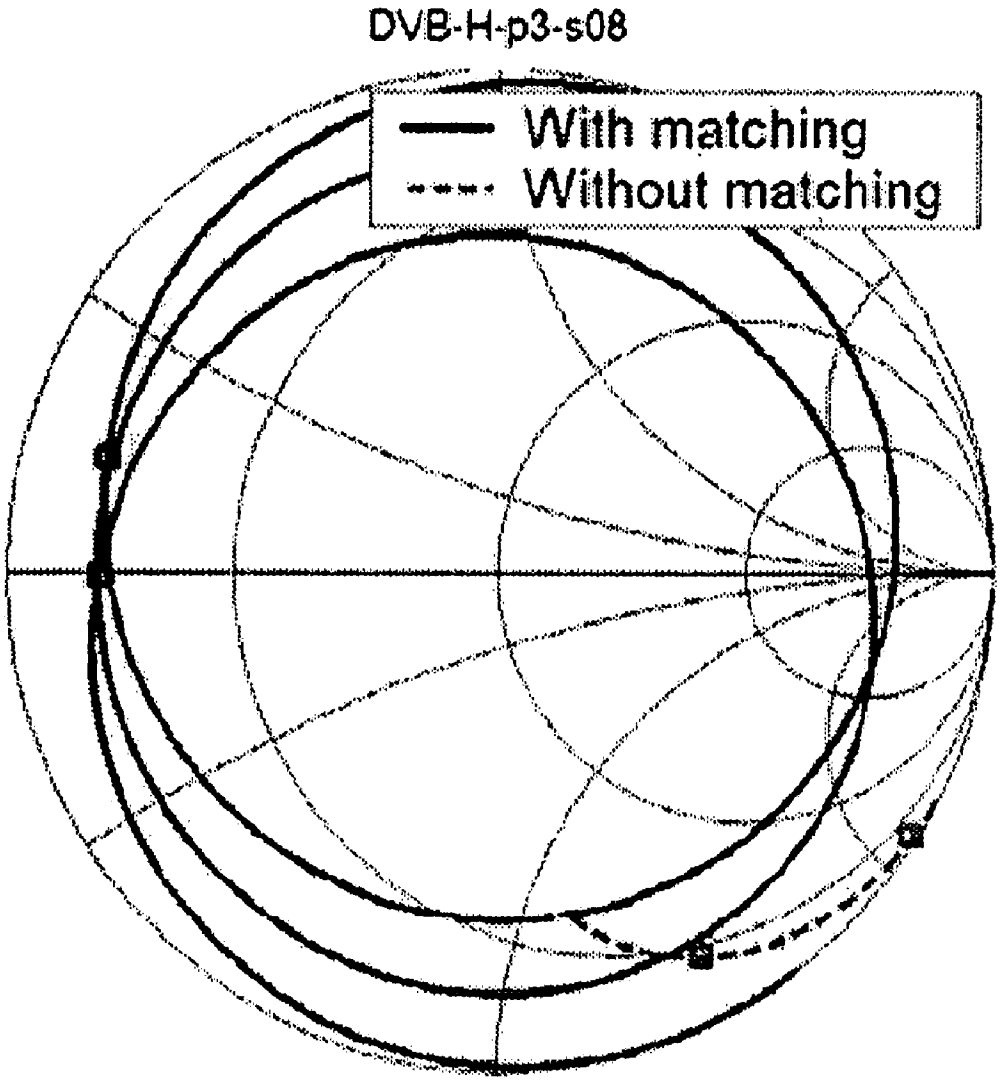
FIG. 4 shows a Smith Chart of the unbalanced non-resonant antenna with and without matching.

A plot of reflection coefficient S11 in the frequency range between 470 MHz and 702 MHz is shown in FIG. 3. As can be seen in FIG. 3, the antenna is resonated at two frequencies when the matching circuit has only one resonance stage. FIG. 4 shows a Smith Chart of the unbalanced non-resonant antenna with and without matching.

The size of the antenna of FIG. 1 is 50 mm×10 mm×6 mm (W×L×H), disposed in relation to a ground plane having a size of 50 mm×110 mm. The air dielectric is $\epsilon_r=1$ and the conductivity of metal parts is $\sigma=1.45\times10^7$.

Second Embodiment

Figure 5:
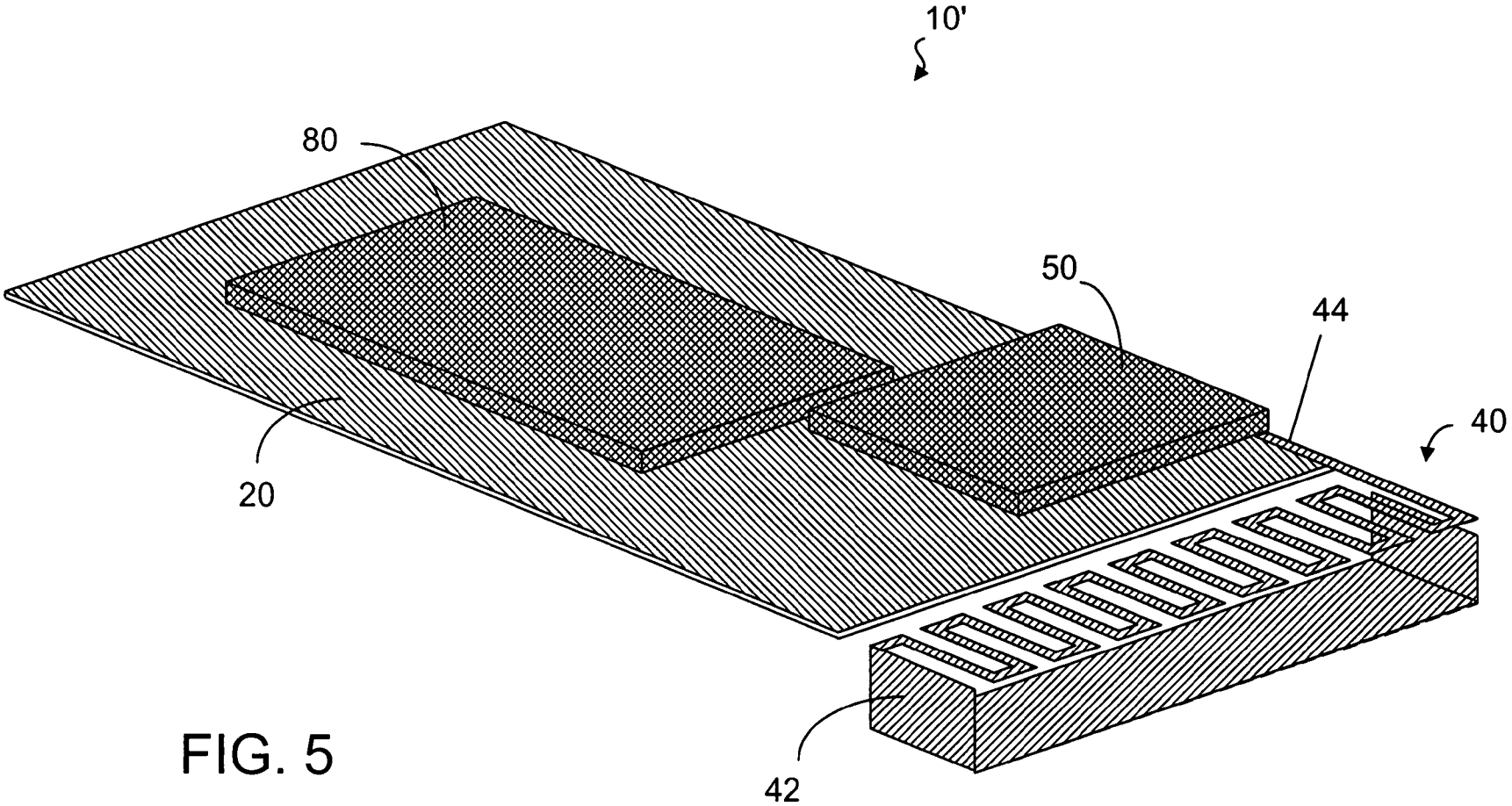
FIG. 5 shows an unbalanced resonant antenna, according to another embodiment of the present invention.

The second embodiment of the present invention is based on a resonant antenna. The radiative element is an elongated strip of electrically conductive material folded at two sides, as shown in FIG. 5. FIG. 5 illustrates a circuit board 10' having a PWB 20 with a ground plane for implementing an unbalanced antenna 40 with a folded radiative element 42 and an antenna feed 44 connected between the radiative element 42 and the PWB 20. The physical length of the radiative element is smaller than λ/4 at the frequencies of interest (470-702 MHz), but the electrical length is about λ/4. In one embodiment, the electrical length is λ/4 at 586 MHz (in the middle of the band). The antenna is made dual-resonant or multi-resonant with a matching circuit, which can be integrated to the antenna module, if necessary. For example, it is possible to include the first inductor in the antenna structure as a meandered metal line, as shown in FIG. 5. As shown in FIG. 5, a matching circuit 50 is connected in series between the antenna 40 and other RF circuitry 80 in an RF front-end.

Figure 6:
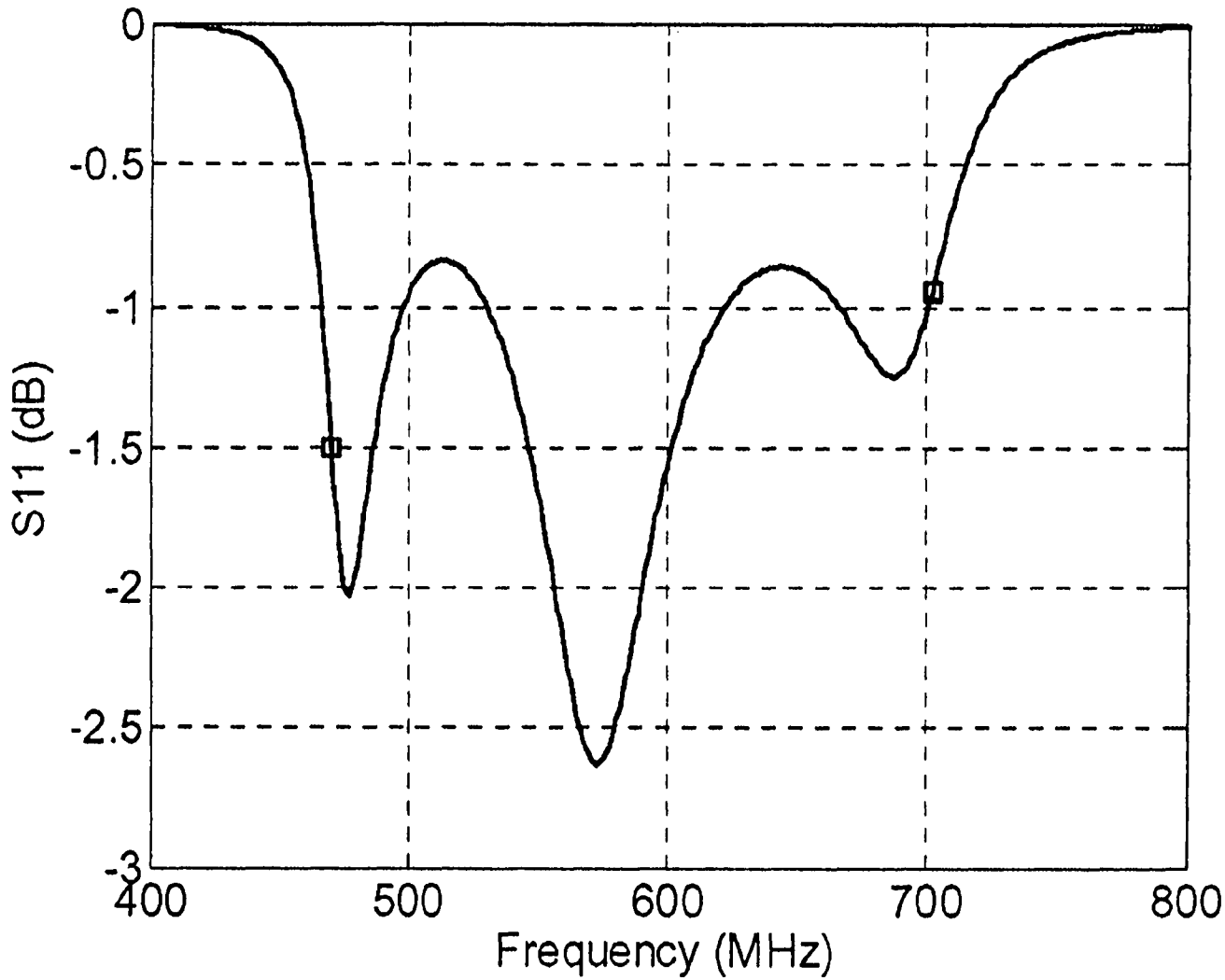
FIG. 6 shows a reflection coefficient S11 with three resonances in the frequency range between 470 MHz and 702 MHz.
Figure 7:
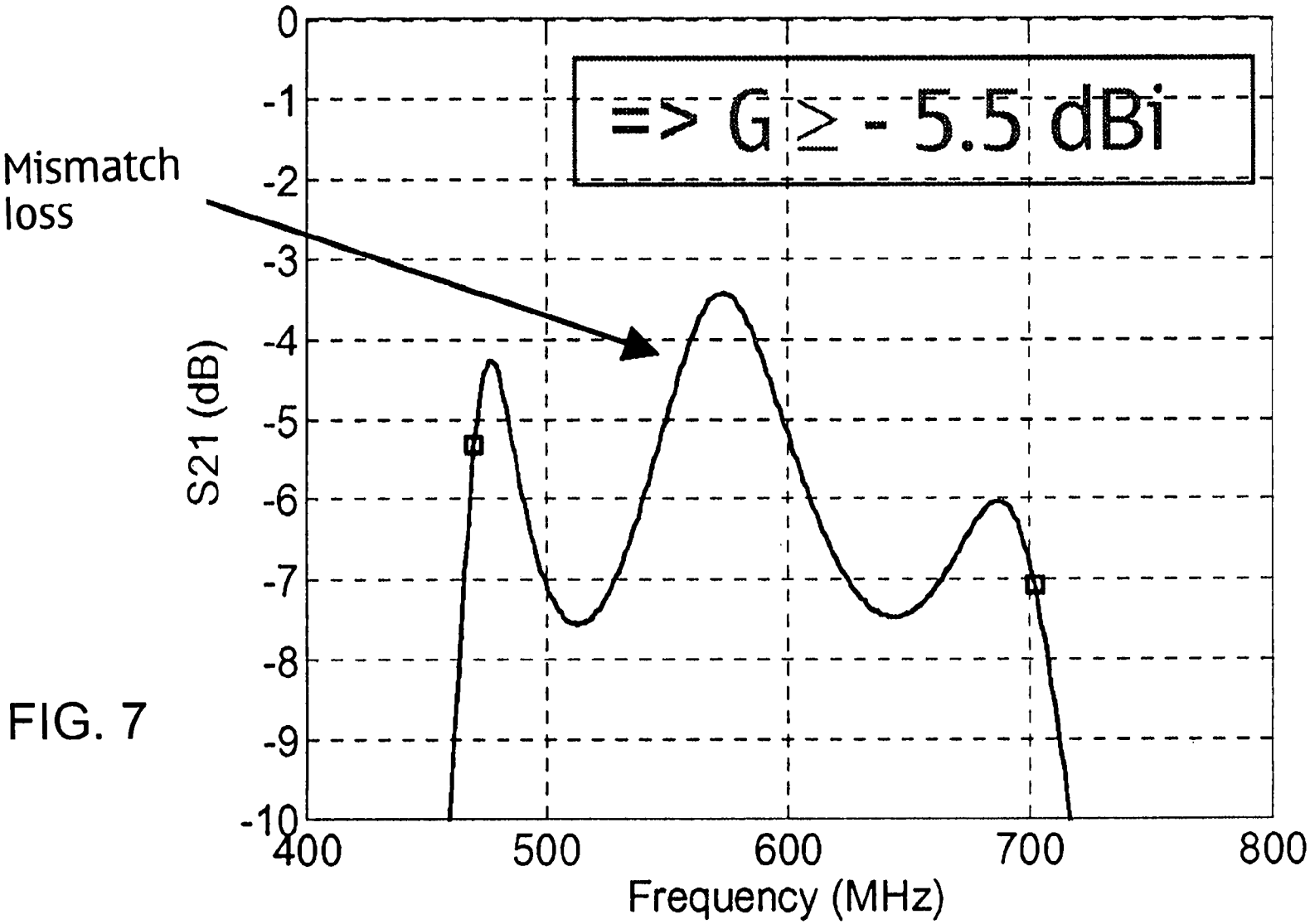
FIG. 7 shows the loss in the antenna gain due to impedance mismatch.

A plot of reflection coefficient S11 in the frequency range between 470 MHz and 702 MHz is shown in FIG. 6. As can be seen in FIG. 6, the antenna is resonated at three frequencies when the matching circuit has two resonance stage. The two-stage matching circuit can be made of lumped elements, for example. The physical size of the antenna of FIG. 5 is 40 mm×10 mm×4 mm (W×L×H). The mismatch loss of the antenna gain is shown in FIG. 7.

Matching Circuit

The matching circuit can be implemented using any known radio-frequency circuit technology, such as lumped components, microstrip or strip lines, coaxial lines, or a combination thereof. Depending on the total number of resonances, one to three resonator stage matching circuit can be used.

One Resonance Stage Matching Circuit

Generally, a one stage resonant matching circuit can comprise a parallel or a series LC resonator (the inductor or the capacitor can of course be realized using any known RF technology). To operate as a matching circuit, the series LC resonator must be connected in series between the feed line connecting the antenna to the other RF circuitry and the antenna feed. A parallel resonant LC circuit must be connected between the ground and the antenna feed or other relevant parts of the matching circuit.

A simple metal plate antenna described according to the first embodiment can be represented by a series resonant circuit, with a resonant frequency typically well above the desired frequency range, because of its electrically small size. Such an antenna can be resonated e.g. by adding a lumped inductor (or a short (<λ/4) section of transmission line) in series between the feed and the antenna. The input impedance of such antenna-inductor combination at resonance is not necessarily 50Ω. Additional components could be used to match the antenna at resonance. However, to optimize the bandwidth, the antenna should not be perfectly matched to 50Ω at any frequency in the DVB-H band.

Two to Three Stage Matching Circuit

Figure 8:
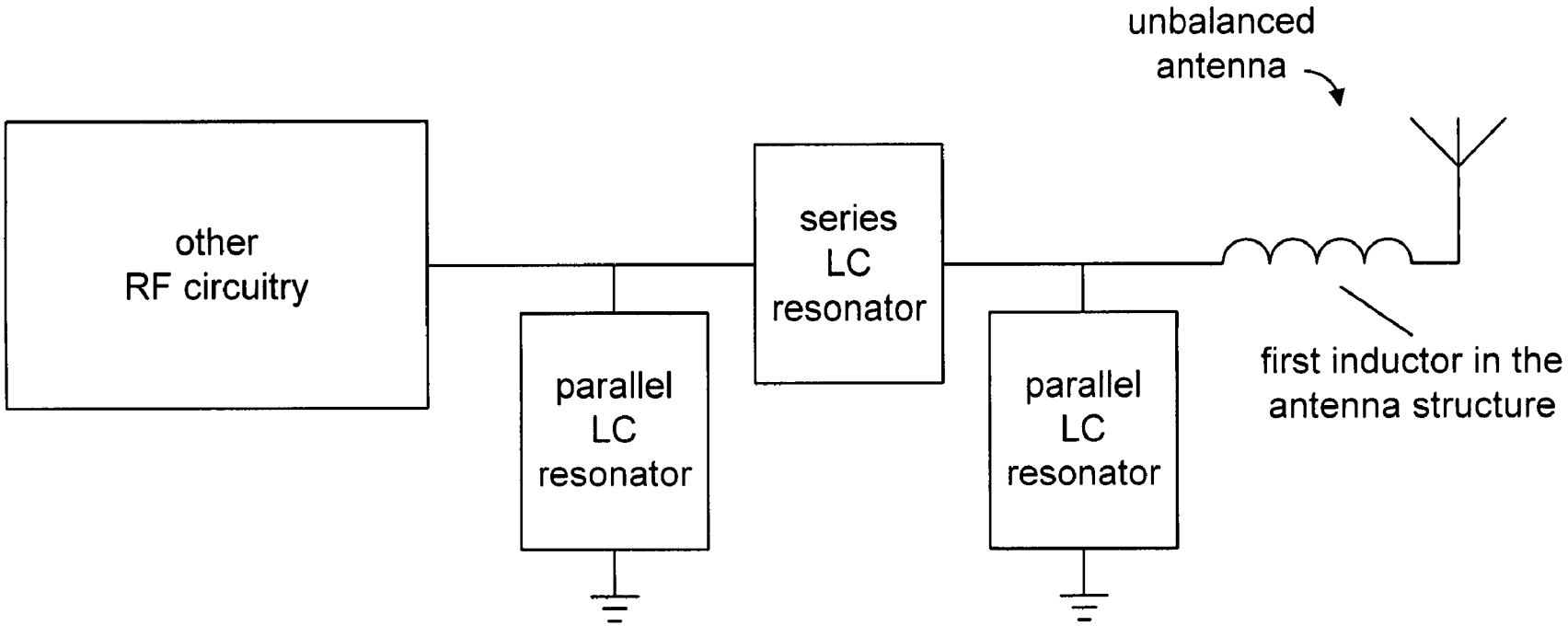
FIG. 8 shows a three-stage resonant matching circuit comprising two parallel LC resonators and one series LC resonator.

A two to three stage resonant matching circuit can contain both parallel LC and series LC circuits in band-pass configuration, for example, so that a parallel LC circuit connected in parallel is followed by a series LC circuit connected in series which is then followed by another parallel LC circuit connected in parallel. One LC circuit with an LC pair represents one stage. Additionally, the antenna represents one resonator either by itself (self-resonant antenna) or when tuned to resonance with one or more external components. A block diagram of an exemplary three stage matching circuit is shown in FIG. 8.

Band Tuning

Figure 9:
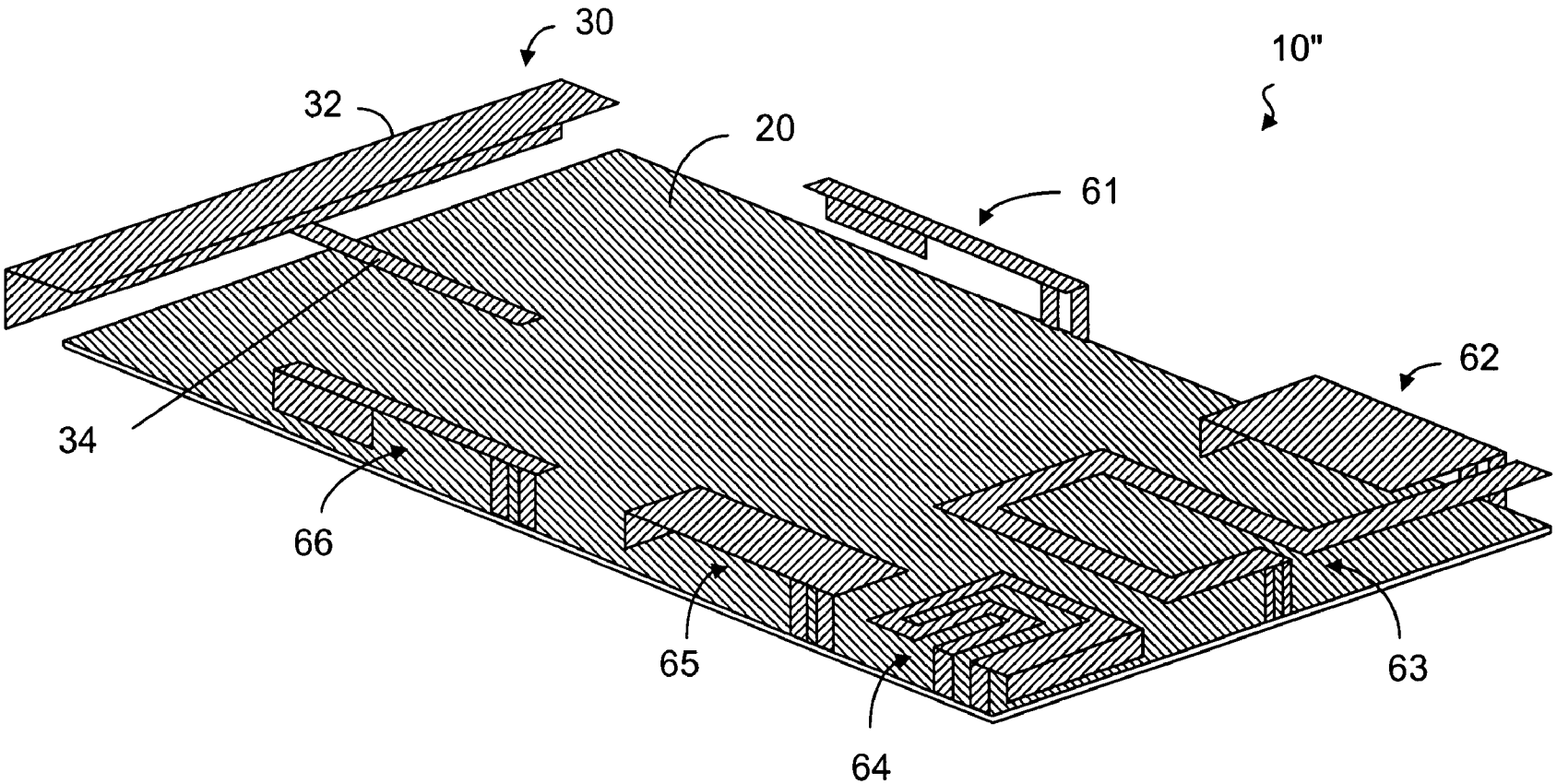
FIG. 9 shows the integration of antennas in a multi-radio antenna system.

Using a simple switching system and lumped passive components, the DVB-H antenna can be tuned to other bands above the DVB-H frequencies and used as a diversity or MIMO antenna, for example. Diversity antennas located at the opposite end of the printed-wire board (PWB), for example, from the main cellular antenna can provide sufficient diversity performance. FIG. 9 illustrates an integrated antenna system 10" having a GSM 850/900 antenna 63, a UMTS antenna 62, a GPS antenna 64 and a GSM 1800/1900 UMTS diversity antenna 65 disposed on one end of a PWB 20, and a DVB-H antenna 30 disposed on the other end. There are also a WLAN antenna 61 and a Bluetooth antenna 66 disposed on the sides of the PWB.

Figure 10:
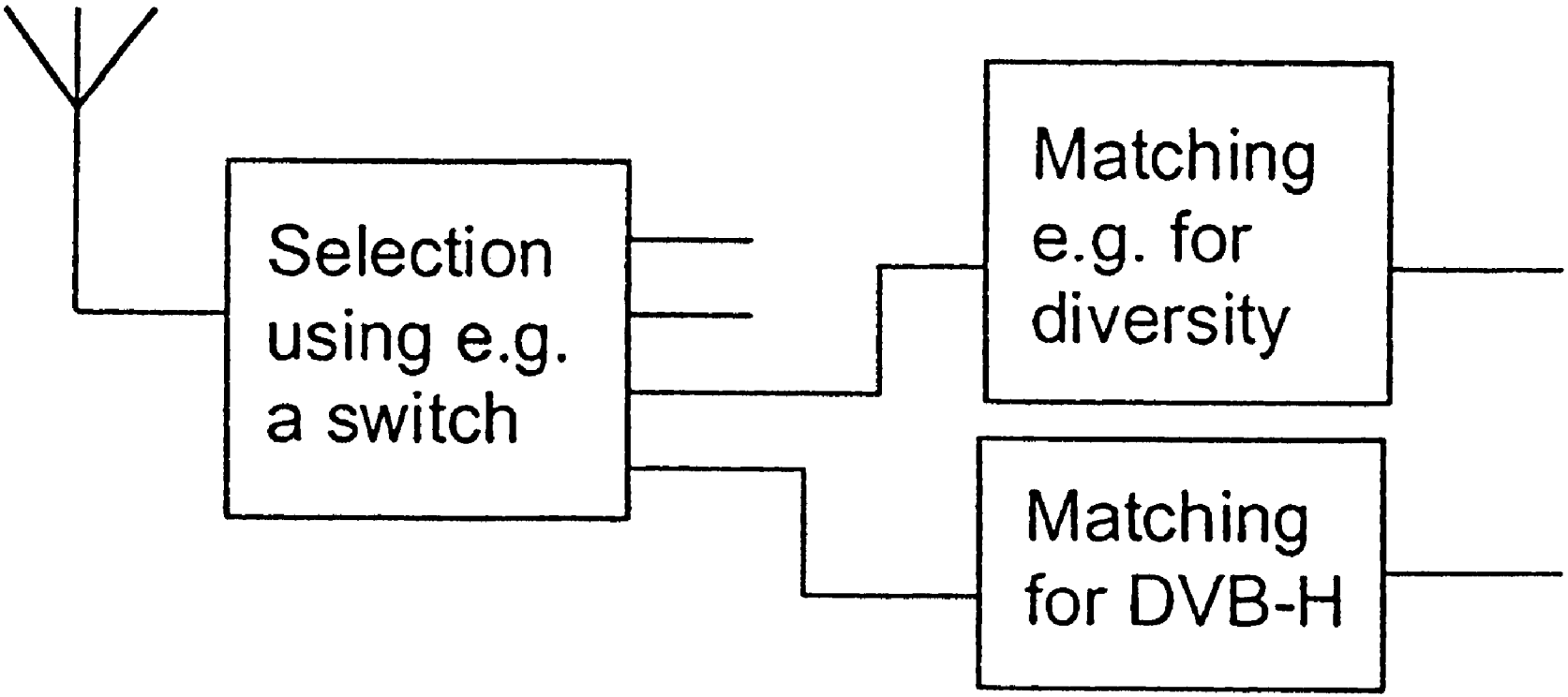
FIG. 10 shows a switching circuit for matching selection.

A simple switched matching circuit for tuning is shown in FIG. 10. The antenna can be tuned to any band above the DVB-H band and used as a diversity antenna, for example, for cellular systems (such as CDMA, GSM, or WCDMA) or for other radio systems, such as WLAN. The matching circuit for diversity can consist of any known RF component. The switch can be any type of RF switch.

In sum, the present invention uses the combination of an antenna and a matching circuit that optimizes a dual-resonant or multi-resonant impedance match to achieve a level of performance (minimum return loss of about 1 dB to 3 dB) traditionally considered too poor for mobile terminal antennas. Conventionally, a return loss of a least 6 dB or even 10 dB is required. With the present invention, the realized gain requirement from −10 dBi (at 470 MHz) to −7 (at 702 MHz) can be met using a simple, relatively compact passive antenna structure.

The number of resonators and the complexity of the needed matching circuit depends on the size of the PWB and the required total efficiency and gain. Some antenna elements can utilize the resonant modes of the ground plane better than the others. It would be advantageous to use those antenna elements having better coupling to the resonant modes of the ground plane (PWB).

The major advantages of the present invention are that the antenna system is simple, and that non-linear semiconductor components are not necessary. The antenna system has better gain and total efficiency than that achievable from a balanced narrow-band frequency-tunable antenna of comparable size.

Reduction of Total Antenna Size

By re-using a fairly large DVB-H antenna as a receive or transmit diversity antenna (or both) for any other radio system than DVB-H, it is possible to make the total volume occupied by a multiradio antenna system smaller as separate diversity antennas are not needed. Because the DVB-H antenna is relatively large, its self-resonant frequency can be close to 2 GHz and thus it can be suitable for 2 GHz systems without any additional matching. It is possible to tune the antenna to any band above the DVB-H frequencies with additional matching. The switched arrangement presented above is one option. The antenna could also contain two or more separate feeds, which would make a switch unnecessary. Matching components can be attached to each feed to match them simultaneously to different bands.

It should be appreciated by those skilled in the art that the antenna shapes and sizes as shown in FIGS. 1 and 5 are for illustration purposes only. These antennas are used to show that an unbalanced resonant or non-resonant antenna can be used in a portable telecommunication device, such as a mobile phone, for receiving DVB-H signals. The antenna can be made resonant at two or more frequencies with in the frequency range between 470 MHz and 702 MHz by using a one or more stage matching circuit. In general, a one stage resonant matching circuit comprises either a parallel or a series LC resonator. A two to three stage resonant matching circuit can contain both parallel and series LC resonators. It should be appreciated by a person skilled in the art that, although the present invention has been disclosed mainly in relation to the frequency range of 470-702 MHz, the present invention is applicable to an antenna structure in other frequency ranges as well.

Figure 11:
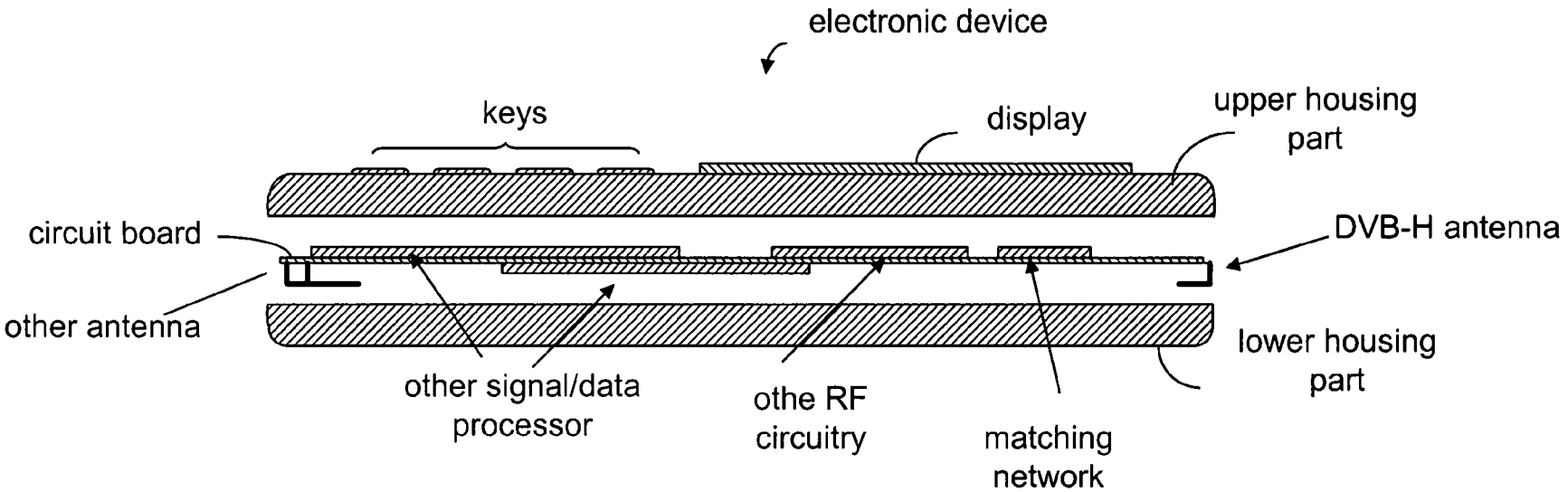
FIG. 11 illustrates an electronic device having an internal antenna for receiving digital-video broadcasting signals.

The antenna structure 10, 10' can be used in a hand-held electronic device, such as a mobile phone, a personal digital assistant, a musical player, a mobile television set and the like. FIG. 11 illustrates one such electronic device. As shown in FIG. 11, the electronic device has a housing to house a circuit board. The circuit board can be used to dispose the antenna structure for receiving the digital-video broadcasting signals as shown in FIGS. 1 and 5. The circuit board may have other antennas for receiving RF signals beyond the DVB-H frequency range. The electronic device further comprises a display device for displaying the images from the digital-video broadcasting signals. The electronic device may have one or more keys to allow a user to enter information in the electronic device.

Thus, although the invention has been described with respect to one or more embodiments thereof, it will be understood by those skilled in the art that the foregoing and various other changes, omissions and deviations in the form and detail thereof may be made without departing from the scope of this invention.

What is claimed is:

1. A method comprising:

providing an unbalanced antenna having a radiative element and a feed line in an antenna structure; and electrically coupling the antenna to a matching circuit having at least one resonance stage to achieve at least two resonances within a frequency range for receiving digital video broadcasting signals, the matching circuit comprising at least one resonator connected to the feed line.

2. The method of claim 1, wherein the frequency range is substantially between 470 MHz and 702 MHz.

3. The method of claim 1, wherein the antenna structure is dimensioned for use in a communication device having a radio-frequency circuitry for processing broadcasting signals, said method further comprising the step of:

connecting the matching circuit in series between the feed line and the radio-frequency circuitry.

4. An antenna structure comprising:

an unbalanced antenna having a radiative element and a feed line; and a matching circuit having at least one resonance stage electrically coupled to the antenna, the matching circuit comprising at least one resonator connected to the feed line so as to achieve at least two resonances within a frequency range for receiving digital video broadcasting signals.

5. The antenna structure of claim 4, wherein the frequency range is substantially between 470 MHz and 702 MHz.

6. The antenna structure of claim 4, wherein the frequency range is corresponding to a wavelength range in electromagnetic radiation and the radiative element has a length smaller than a quarter of a wavelength within said wavelength range.

7. The antenna structure of claim 4, wherein the frequency range is corresponding to a wavelength range in electromagnetic radiation and the radiative element has a length substantially equal to a quarter of a wavelength within said wavelength range.

8. The antenna structure of claim 4, further comprising a radio-frequency circuitry for processing the broadcasting signal, wherein the matching circuit is connected in series between the radio-frequency circuitry and the feed line.

9. The antenna structure of claim 4, wherein the matching circuit comprises at least one inductor-capacitor resonator made of at least one inductor and one capacitor connected in series or in parallel.

10. The antenna structure of claim 4, wherein the unbalanced antenna is disposed on a circuit board having a ground plane and the matching circuit comprises at least one inductor-capacitor resonator made of at least one inductor and one capacitor connected in parallel, and wherein the inductor-capacitor resonator is connected between the ground plane and the feed line.

11. The antenna structure of claim 4, further comprising:

at least one transceiver for receiving and transmitting signals in a further frequency range different from the digital-video broadcasting signals; and a switching system operatively connected to the unbalanced antenna and the transceiver so as to allow a hand-held telecommunication device to receive the digital-video broadcasting signals and to receive or transmit signals in the further frequency range simultaneously.

12. The antenna structure of claim 4, further comprising:

at least one transceiver for receiving and transmitting signals in a further frequency range different from the digital-video broadcasting signals; and a switching system operatively connected to the unbalanced antenna and the transceiver so as to allow the hand-held telecommunication device to receive the digital-video broadcasting signals and to receive or transmit signals in the further frequency range by taking turns.

13. An electronic device, comprising:

a housing;

a circuit board having a ground plane;

an unbalanced antenna disposed on the circuit board inside the housing for receiving digital-video broadcasting signals in a frequency range, the unbalanced antenna having a radiative element and a feed line; and a matching circuit having at least one resonance stage electrically coupled to the antenna, the matching circuit comprising at least one resonator connected to the feed line so as to achieve at least two resonances within said frequency range.

14. The electronic device of claim 13, wherein the frequency range is substantially between 470 MHz and 702 MHz.

15. The electronic device of claim 13, wherein the frequency range is corresponding to a wavelength range in electromagnetic radiation and the radiative element has a length smaller than a quarter of a wavelength within said wavelength range.

16. The electronic device of claim 13, wherein the frequency range is corresponding to a wavelength range in electromagnetic radiation and the radiative element has a length substantially equal to a quarter of a wavelength within said wavelength range.

17. The electronic device of claim 13, further comprising:

at least one transceiver for receiving and transmitting signals in a further frequency range different from the digital-video broadcasting signals; and a switching system operatively connected to the unbalanced antenna and the transceiver so as to allow a hand-held telecommunication device to receive the digital-video broadcasting signals and to receive or transmit signals in the further frequency range simultaneously.

18. The electronic device of claim 13, further comprising:

at least one transceiver for receiving and transmitting signals in a further frequency range different from the digital-video broadcasting signals; and a switching system operatively connected to the unbalanced antenna and the transceiver so as to allow a hand-held telecommunication device to receive the digital-video broadcasting signals and to receive or transmit signals in the further frequency range by taking turns.

19. The electronic device of claim 17, wherein the unbalanced antenna is disposed on one end of the circuit board, said electronic device further comprising:

a further antenna operatively connected to the transceiver for receiving and transmitting signals in the further frequency range beyond said frequency range, the further antenna disposed on a different end of the circuit board; and a tuning device, operatively connected to the unbalanced antenna, for tuning the unbalanced antenna to the further frequency range so that the unbalanced antenna is used as a diversity antenna to the further antenna.

20. The electronic device of claim 13, comprising a mobile phone.

21. The electronic device of claim 13, comprising a mobile television set.

* * * * *